US008499403B2

(12) United States Patent
Wang

(10) Patent No.: US 8,499,403 B2
(45) Date of Patent: Aug. 6, 2013

(54) BRUSH

(76) Inventor: Huo-Pia Wang, Chang-Hua (TW)

( * ) Notice: Subject to any disclaimer, the term of this patent is extended or adjusted under 35 U.S.C. 154(b) by 89 days.

(21) Appl. No.: 13/020,580

(22) Filed: Feb. 3, 2011

(65) Prior Publication Data

US 2012/0060311 A1 Mar. 15, 2012

(51) Int. Cl.
*A46B 9/08* (2006.01)

(52) U.S. Cl.
USPC ..... 15/169; 132/119

(58) Field of Classification Search
USPC ..... 15/168, 169; 132/119
See application file for complete search history.

(56) References Cited

U.S. PATENT DOCUMENTS

| | | | | |
|---|---|---|---|---|
| 3,737,936 | A * | 6/1973 | Uosaki | 15/169 |
| 4,152,806 | A * | 5/1979 | Raaf et al. | 15/169 |
| 6,427,633 | B1 | 8/2002 | Ogden | |
| 2007/0169293 | A1 | 7/2007 | Wang | |
| 2012/0060311 | A1 | 3/2012 | Wang | |

FOREIGN PATENT DOCUMENTS

JP 10028615 A 2/1998

OTHER PUBLICATIONS

Search Report received in corresponding EU Application No. 12158812.3-1269, Aug. 16, 2012.

* cited by examiner

*Primary Examiner* — Randall Chin
(74) *Attorney, Agent, or Firm* — Banner & Witcoff, Ltd.

(57) ABSTRACT

A brush includes: a brush body having a base plate, at least one through hole, and a guide rail; a bristle unit including a plurality of bristles connected to the base plate; a hair-removing plate disposed movably below the base plate and formed with a plurality of bristle holes; a push member disposed above the base plate and connected slidably to the guide rail; and at least one flexible strip that extends through the through hole and that is connected to the push member and the hair-removing plate. The push member is slidable along the guide rail and toward or away from the through hole so as to move the hair-removing plate away from or toward the base plate. The hair-removing plate moves away from the lower surface of the base plate when the push member slides toward the through hole.

8 Claims, 10 Drawing Sheets

BRUSH

BACKGROUND OF THE INVENTION

1. Field of the Invention

This invention relates to a brush, more particularly to a brush capable of facilitating removal of tangled hair strands from bristles thereof.

2. Description of the Related Art

FIG. 1 shows a brush that is disclosed in U.S. patent application publication no. 2007/0169293. The brush includes a brush body 1, a handgrip 2 connected to the brush body 1, a bristle unit 3, an operating member 4, and a biasing member 5. The brush body 1 has an upper wall 101, a lower wall 102 movable toward and away from the upper wall 101, and two guiding plates 103 extending from the lower wall 102 and through the upper wall 101 to be exposed from the upper wall 101. The bristle unit 3 is disposed on a bottom side of the upper wall 101 and has a plurality of bristles 301. The lower wall 102 is formed with a plurality of bristle apertures 104 to permit the bristles 301 to pass therethrough so that the bristles 301 are exposed from a combing surface 105 of the lower wall 102. The operating member 4 is connected to two top ends of the two guiding plates 103. The biasing member 5 biases the operating member 4 to pull the lower wall 102 toward the upper wall 101. When the operating member 4 is pressed downwardly, the guiding plates 103 and the lower wall 102 are moved away from the upper wall 101 and slid along the bristles 301, thereby removing tangled hair strands collected among the bristles 310.

However, since all of the lower wall 102, the guiding plates 103, and the operating member 4 are arranged to move in the same direction, the conventional brush has a relatively large height that is hard to minimize.

SUMMARY OF THE INVENTION

Therefore, an object of the present invention is to provide a brush that can overcome the aforesaid drawback associated with the prior art.

Accordingly, a brush of the present invention comprises:

a brush body including a base plate, at least one through hole extending through upper and lower surfaces of the base plate, and a guide rail extending above and along the upper surface;

a bristle unit including a plurality of bristles connected to the base plate adjacent to the lower surface and extending in a direction transverse to the upper and lower surfaces;

a hair-removing plate disposed movably below the lower surface of the base plate and formed with a plurality of bristle holes to permit the bristles to pass therethrough;

a push member disposed above the upper surface of the base plate and connected slidably to the guide rail; and at least one flexible strip that extends through the through hole, that is connected to the push member and the hair-removing plate, and that has a first section extending along the upper surface from the push member toward the through hole, and a second section bending from the first section and extending through the through hole to connect to the hair-removing plate, the push member being slidable along the guide rail and toward or away from the through hole so as to move the hair-removing plate away from or toward the lower surface, the hair-removing plate moving away from the lower surface when the push member slides toward the through hole.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
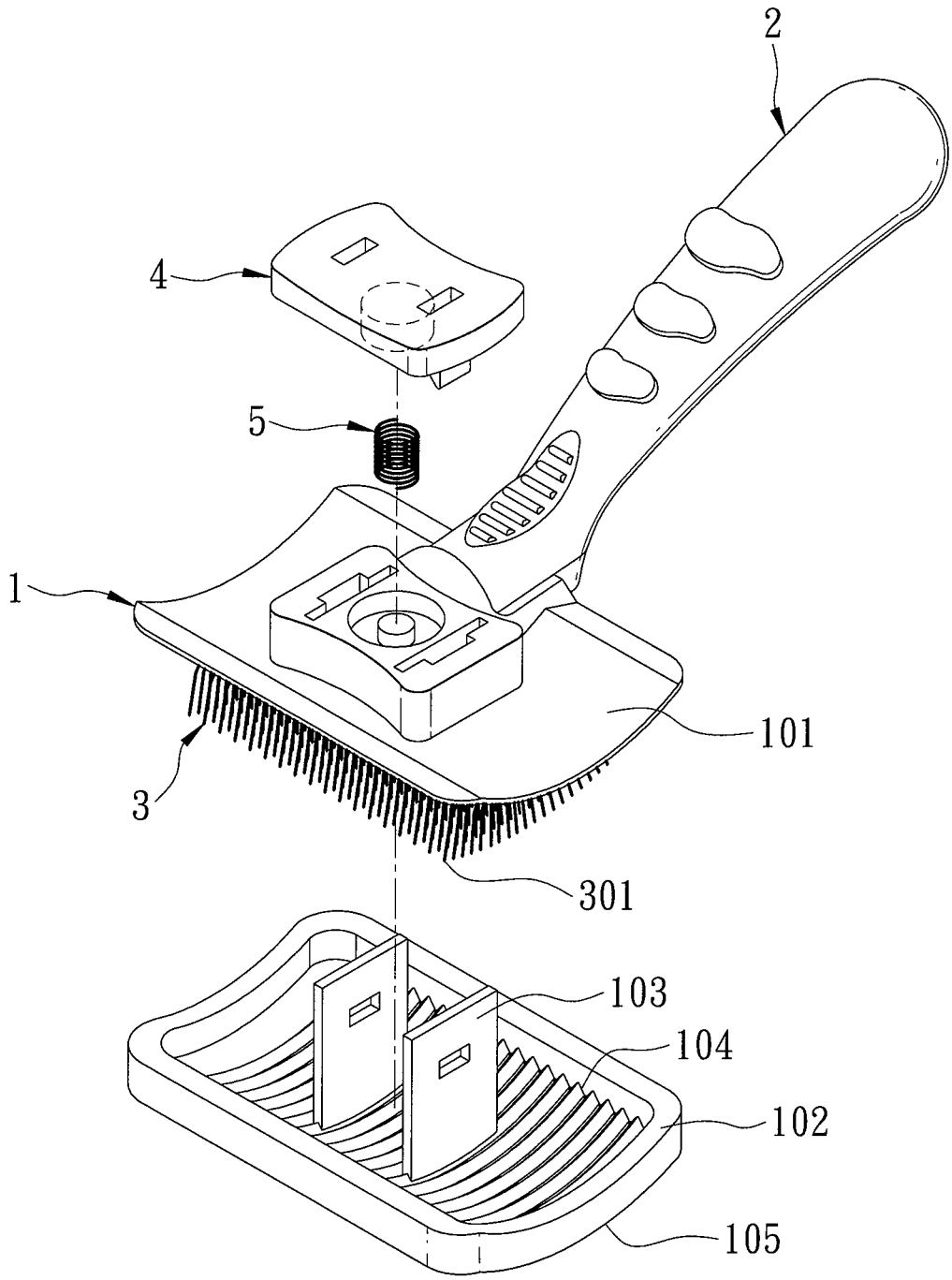
FIG. 1 PRIOR ART
FIG. 1 is an exploded perspective view of a conventional brush.

Before the present invention is described in greater detail with reference to the accompanying preferred embodiments, it should be noted herein that like elements are denoted by the same reference numerals throughout the disclosure.

Figure 2:
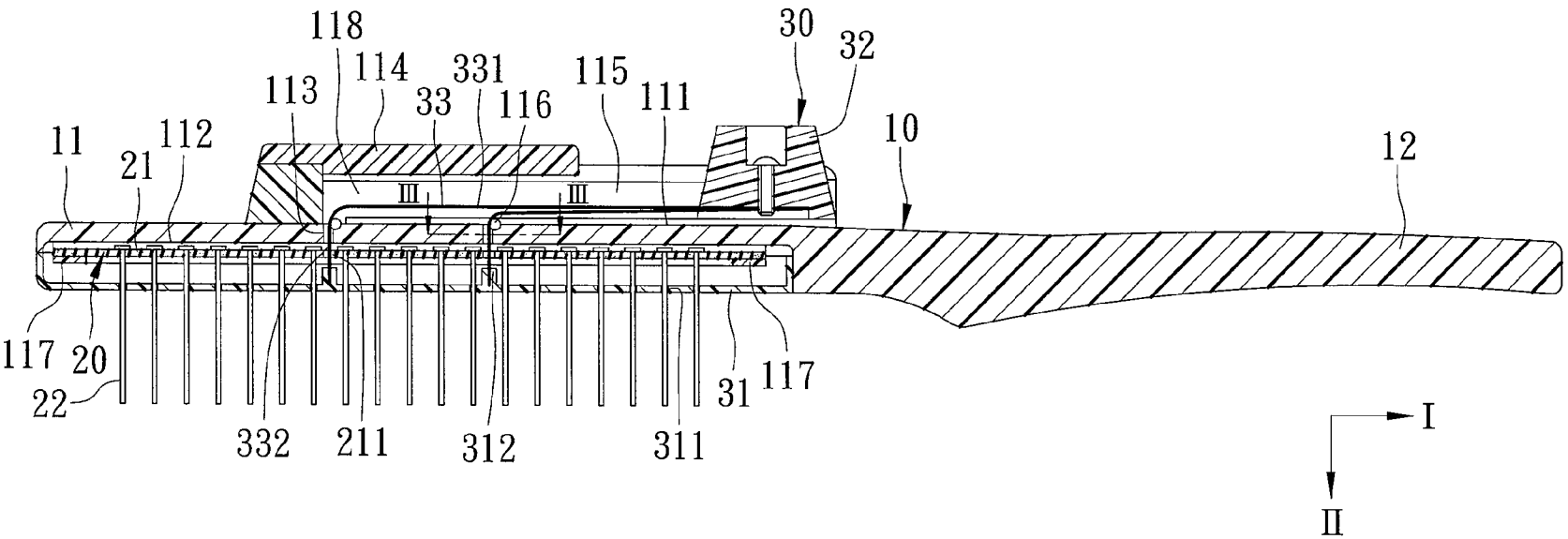
FIG. 2 is a sectional view of the first preferred embodiment of a brush according to the present invention.
Figure 4:
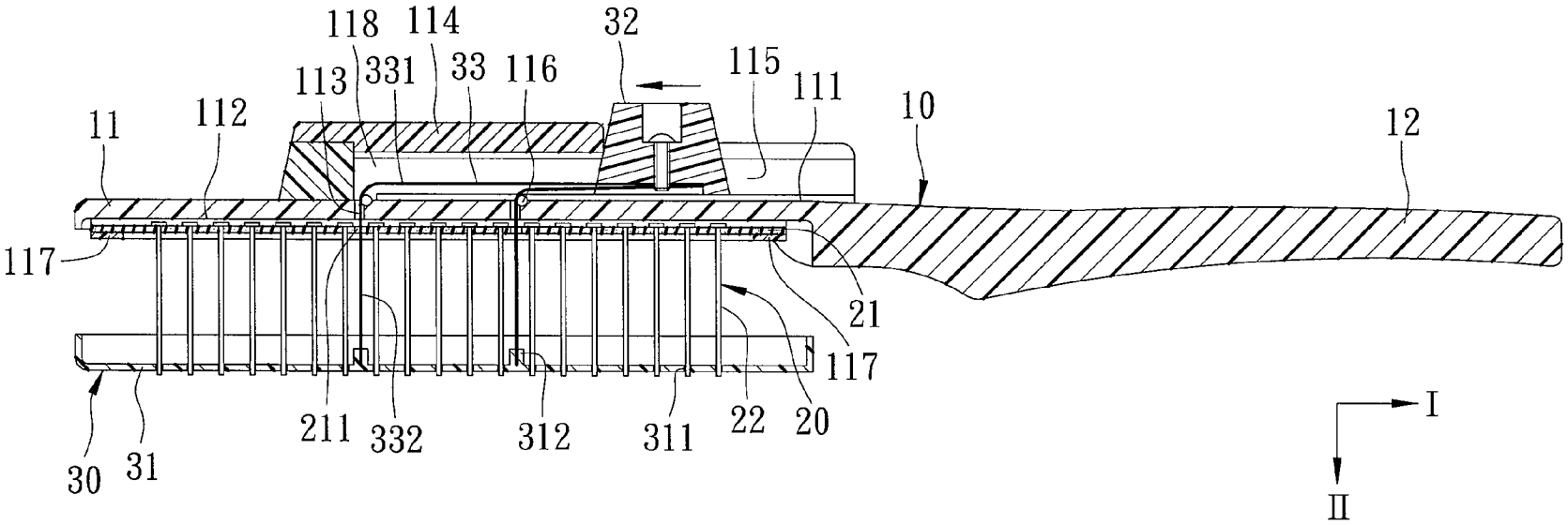
FIG. 4 is the same view as FIG. 2 but illustrating that a hair-removing plate moves away from a base plate when a push member slides toward the through hole.

Referring to FIGS. 2 and 4, the first preferred embodiment of a brush according to the present invention comprises a brush body 10, a bristle unit 20, and an operating member 30.

Figure 3:
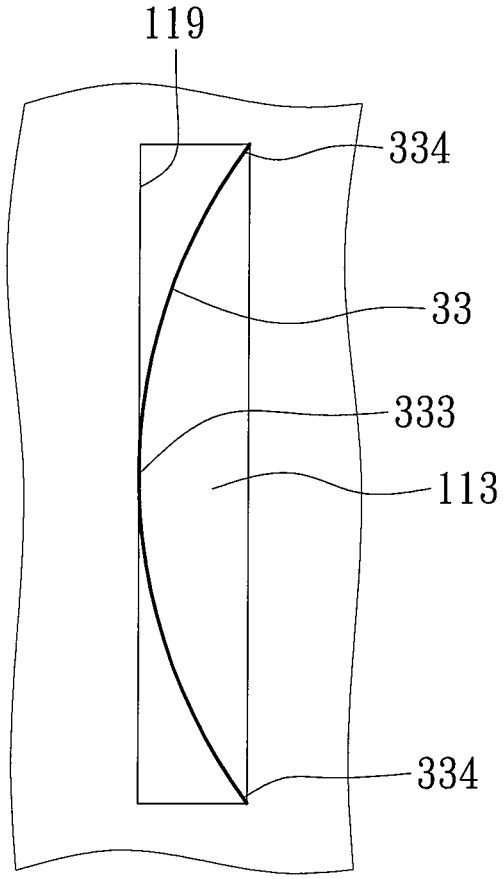
FIG. 3 is a cross-sectional view taken along line III-III in FIG. 2 to illustrate a narrow rectangular through hole.

The brush body 10 extends along a first direction I and includes a base plate 11 and a handgrip 12 extending from the base plate 11 along the first direction I. The base plate 11 has upper and lower surfaces 111, 112, two through holes 113 extending through the upper and lower surfaces 111, 112, a mount 114 protruding from the upper surface 111 of the base plate 11, and a guide rail 115 extending above and along the upper surface 111 of the base plate 11. As shown in FIG. 3, each of the through holes 113 is a narrow rectangular through hole that is confined by a hole wall 119. The mount 114 has a channel formed therein to serve as the guide rail 115, and a hollow space 118 communicated with the channel above the upper surface 111.

Preferably, the brush body 10 further includes two cylindrical guide rods 116 and two retaining plates 117. Each of the cylindrical guide rods 116 is disposed on the upper surface 111 of the base plate 11 in proximity to one of the through holes 113. The retaining plates 117 are connected to the base plate 11 and are spaced apart from the lower surface 112 of the base plate 11.

The bristle unit 20 is disposed at the lower surface 112 of the base plate 11, and includes a bristle plate 21 and a plurality of bristles 22. The bristle plate 21 holds the bristles 22, and is attached to the base plate 11 adjacent to the lower surface 112 by being inserted in between the base plate 11 and the retaining plates 117 at the opposite ends thereof. The bristles 22 extend in a second direction II transverse to the upper and lower surfaces 111, 112 of the base plate 11. The bristle plate 21 has two through slots 211 respectively aligned with the through holes 113 of the base plate 11. The second direction II is substantially perpendicular to the first direction I.

The operating member 30 includes a hair-removing plate 31, a push member 32, and two flexible strips 33.

The hair-removing plate 31 is disposed movably below the bristle plate 21, is formed with a plurality of bristle holes 311 to permit the bristles 22 to pass therethrough, and has two connection parts 312 protruding from an upper surface of the hair-removing plate 31 and respectively aligned with the through slots 211 of the bristle plate 21. The hair-removing plate 31 is movable toward and away from the lower surface 112 of the base plate 11.

The push member 32 is disposed above the upper surface 111 of the base plate 11, and is connected slidably to the guide rail 115.

Each of the flexible strips 33 extends through a corresponding one of the through holes 113 and a corresponding one of the through slots 211, and is connected to the push member 32 and the hair-removing plate 31. Each of the flexible strips 33 has two longitudinally opposite ends, one of which is screwed to the push member 32 and the other of which is connected to a corresponding one of the connection parts 312 of the hair-removing plate 31. The flexible strips 33 are movable along with the push member 32 and extend into the hollow space 118.

In detail, each of the flexible strips 33 has a first section 331 extending along the upper surface 111 of the base plate 11 from the push member 32 toward the corresponding one of the through holes 113, and a second section 332 bending from the first section 331 and extending through the corresponding one of the through holes 113 and the corresponding one of the through slots 211 to connect to the corresponding one of the connection parts 312 of the hair-removing plate 31.

As shown in FIG. 3, each flexible strip 33 has a curve cross section transverse to a length direction of the flexible strip 33, and an intermediate part 333 that is convexed between two longitudinal edges 334 of the flexible strip 33, which are opposite to each other in a transverse direction that is transverse to the length direction. The flexible strip 33 is thus resilient in the transverse direction and is stiff in the length direction. A convexed surface of the intermediate part 333 of each flexible strip 33 contacts resiliently, frictionally and slidingly the hole wall 119 of the corresponding through hole 113.

In FIG. 2, the push member 32 is disposed away from the through holes 113, and the hair-removing plate 31 is retained at a use position in proximity to the bristle plate 21 by virtue of the flexible strips 33 that bulge resiliently to abut against the hole wall 119 of the respective through holes 113.

When the push member 32 is slid toward the through holes 113, the flexible strips 33 push the hair-removing plate 31 away from the lower surface 112 of the base plate 11 and to a cleaning position (see FIG. 4) since the flexible strips 33 are stiff in the length direction thereof. As the hair-removing plate 31 slides along the bristles 22, the tangled hair strands collected among the bristles 22 are removed by the hair-removing plate 31.

In this invention, when the push member 32 slides along the first direction I, the hair-removing plate 31 moves along the second direction II. Accordingly, compared to the conventional brush shown in FIG. 1, the brush of this invention can be provided with a reduced height.

Figure 5:
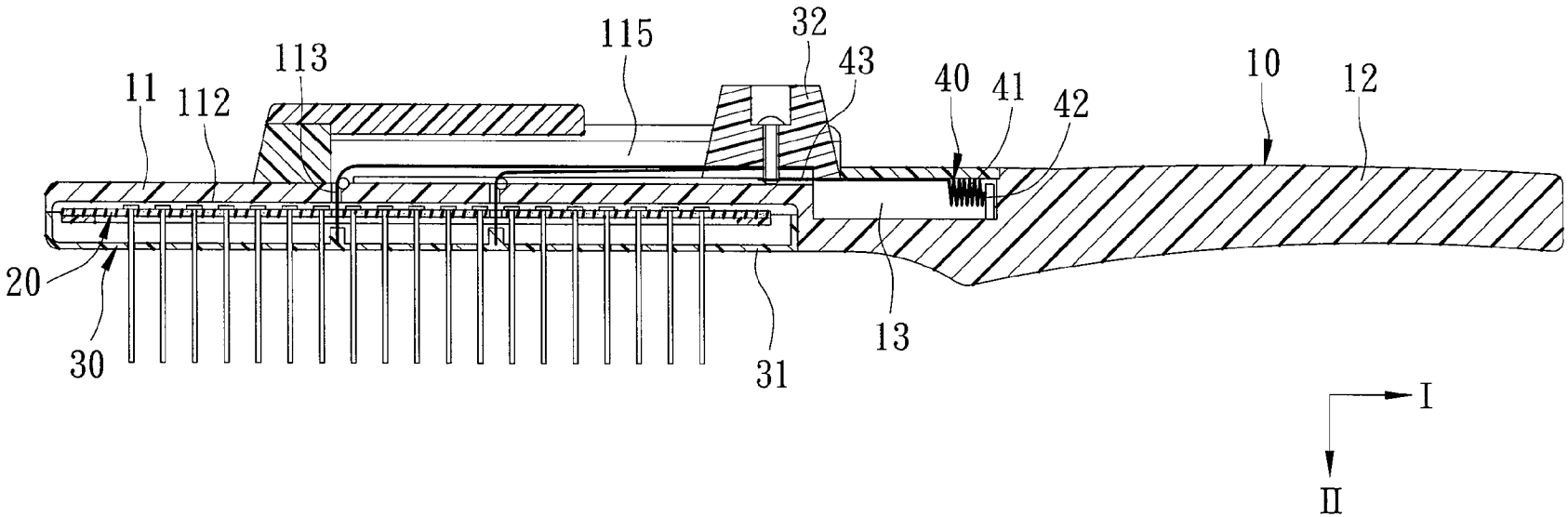
FIG. 5 is a sectional view of the second preferred embodiment of a brush according to the present invention.
Figure 6:
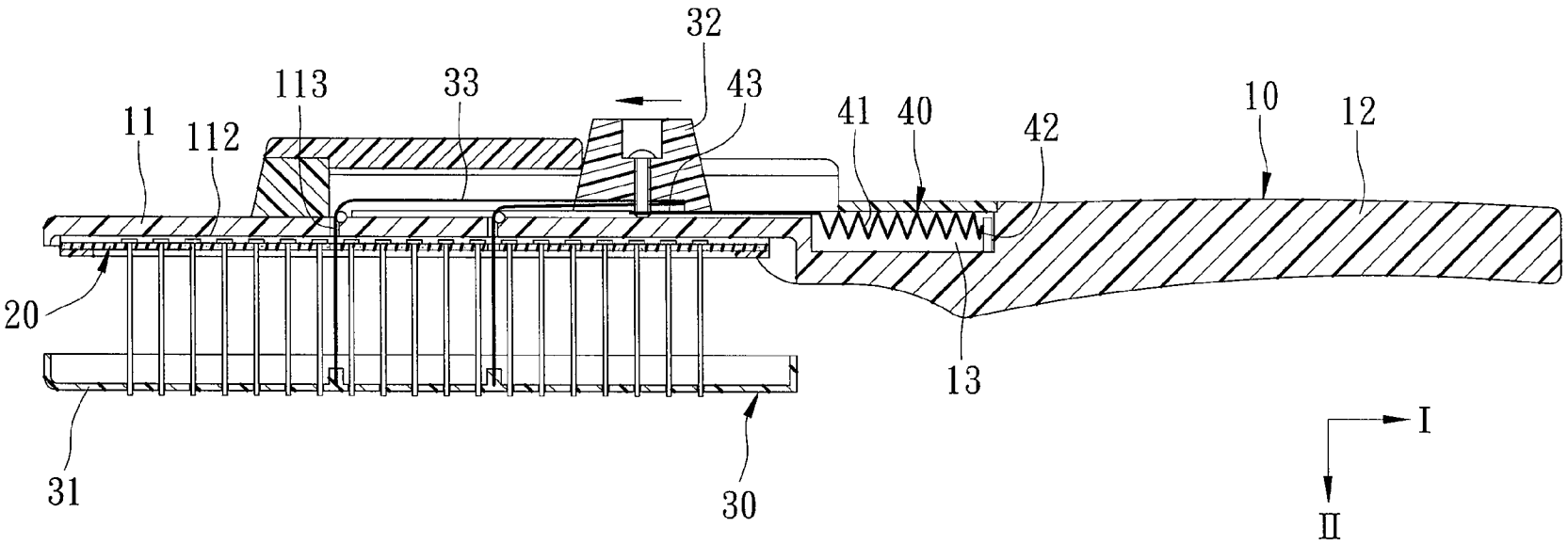
FIG. 6 is the same view as FIG. 5 but illustrating that the hair-removing plate moves away from the base plate when the push member slides toward the through hole.

FIGS. 5 and 6 illustrate the second preferred embodiment of the brush according to the present invention. The second preferred embodiment differs from the first preferred embodiment only in that the brush further includes a receiving recess 13 and a returning spring 40. The receiving recess 13 is indented from a surface of the handgrip 12 proximate to the base plate 11, and is connected to the channel of the guide rail 115. The returning spring 40 is connected between the handgrip 12 and the push member 32, and includes a spring body 41 that is received in the receiving recess 13, a first end 42 that is connected to the handgrip 12, and a second end 43 that is connected to the push member 32. The hair-removing plate 31 is moved away from the lower surface 112 of the base plate 11 when the push member 32 slides toward the through holes 113. The returning spring 40 biases the push member 32 to slide away from the through holes 113 so that the hair-removing plate 31 is normally placed in its use position (i.e., its original position).

As shown in FIG. 5, when an external force is not applied, the push member 32 is kept to slide away from the through holes 113 by virtue of the biasing force provided by the returning spring 40. When an external force greater than the biasing force is applied to the push member 32, the push member 32 is slid toward the through holes 113, and the hair-removing plate 31 is moved away from the lower surface 112 of the base plate 11 to the cleaning position (see FIG. 6).

Figure 7:
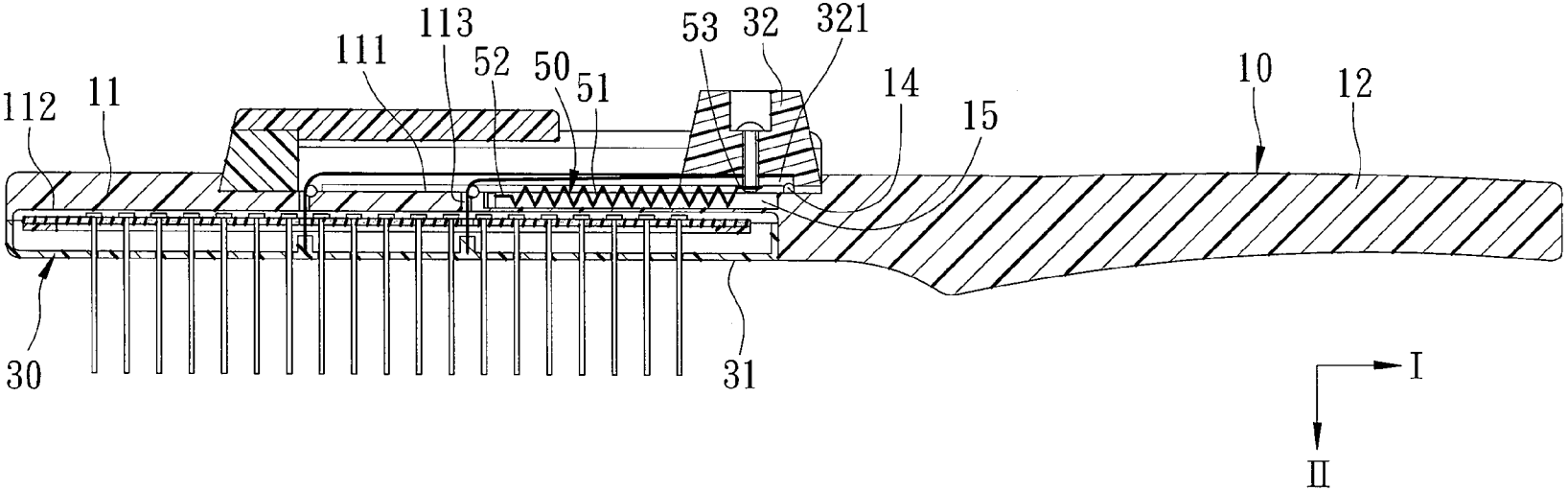
FIG. 7 is a sectional view of the third preferred embodiment of a brush according to the present invention.
Figure 8:
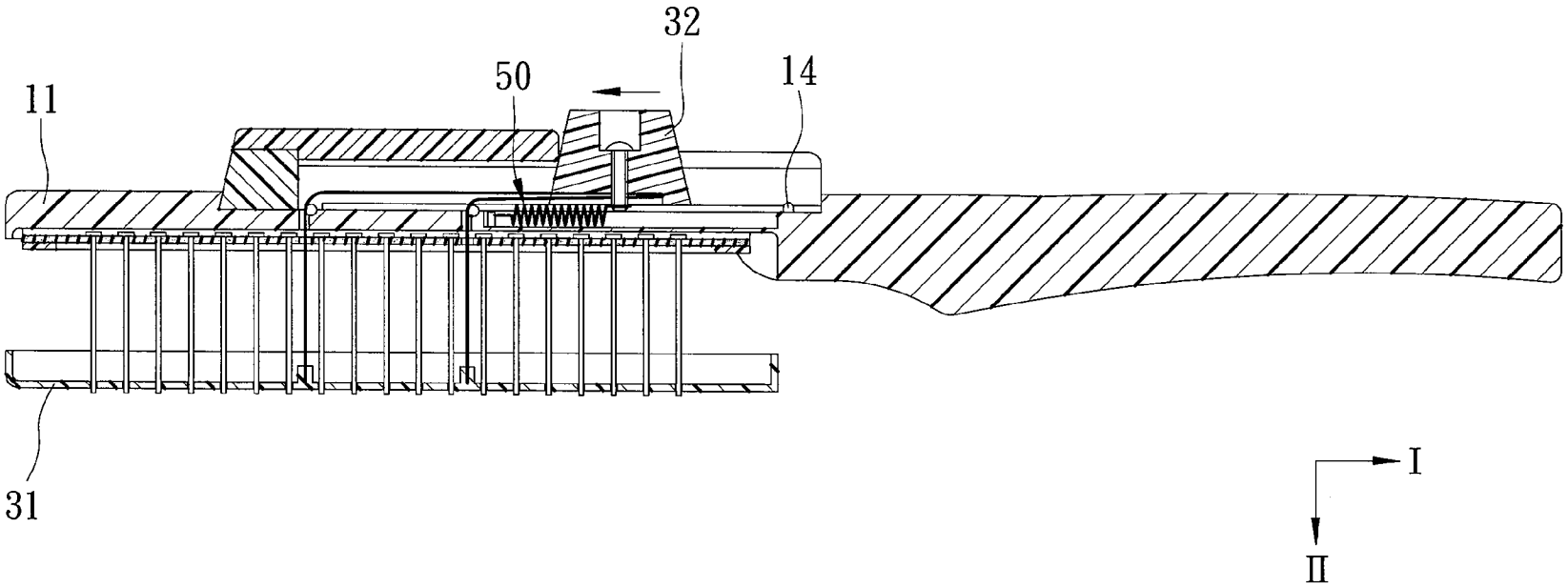
FIG. 8 is the same view as FIG. 7 but illustrating that the hair-removing plate moves away from the base plate when the push member slides toward the through hole.

FIGS. 7 and 8 illustrate the third preferred embodiment of the brush according to the present invention. The third preferred embodiment differs from the first preferred embodiment only in that the brush further includes a locking element 14, a receiving recess 15, and a returning spring 50. The receiving recess 15 is indented from the upper surface 111 of the base plate 11 in proximity to the handgrip 12. The returning spring 50 is connected between the base plate 11 and the push member 32, and includes a spring body 51 that is received in the receiving recess 15, a first end 52 that is connected to the base plate 11, and a second end 53 that is connected to the push member 32. The hair-removing plate 31 is moved away from the lower surface 112 of the base plate 11 when the push member 32 slides toward the through holes 113. The returning spring 50 biases the push member 32 to slide toward the through holes 113 so that the hair-removing plate 31 is normally placed in its cleaning position.

The locking element 14 is disposed at the upper surface 111 of the base plate 11 to interlock with the push member 32 after the push member 32 is slid away from the through holes 113 to move the hair-removing plate 31 toward the lower surface 112 of the base plate 11.

In the third preferred embodiment, the locking member 14 is a protrusion protruding from the upper surface 111 of the base plate 11. The push member 32 is formed with a recess 321 at its bottom surface, which is adapted to interlock with the protrusion of the locking member 14.

As shown in FIG. 7, when the push member 32 is interlocked with the locking member 14, the hair-removing plate 31 is fixed in its use position, and the returning spring 50 is stretched to store energy.

Referring to FIG. 8, after the external force is applied to the push member 32 to slide the push member 32 past the locking member 14, the push member 32 can slide toward the through holes 113 by the biasing force of the returning spring 50. Accordingly, the hair-removing plate 31 is slid from the use position toward the cleaning position.

Figure 9:
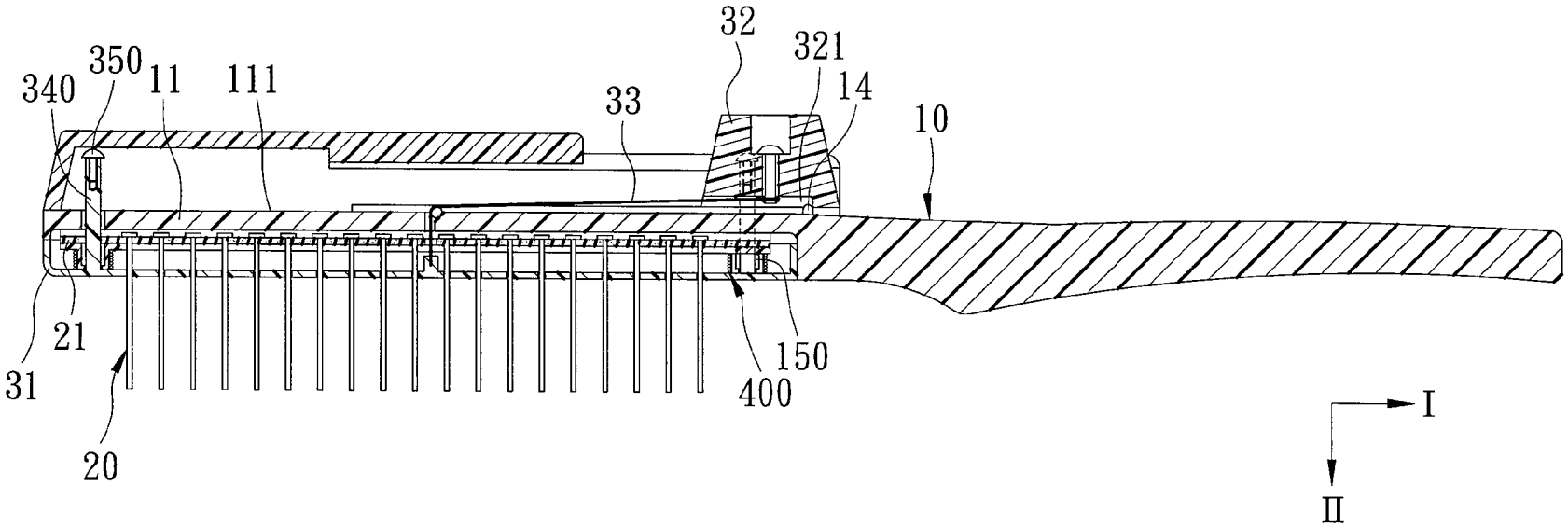
FIG. 9 is a sectional view of the fourth preferred embodiment of a brush according to the present invention.
Figure 10:
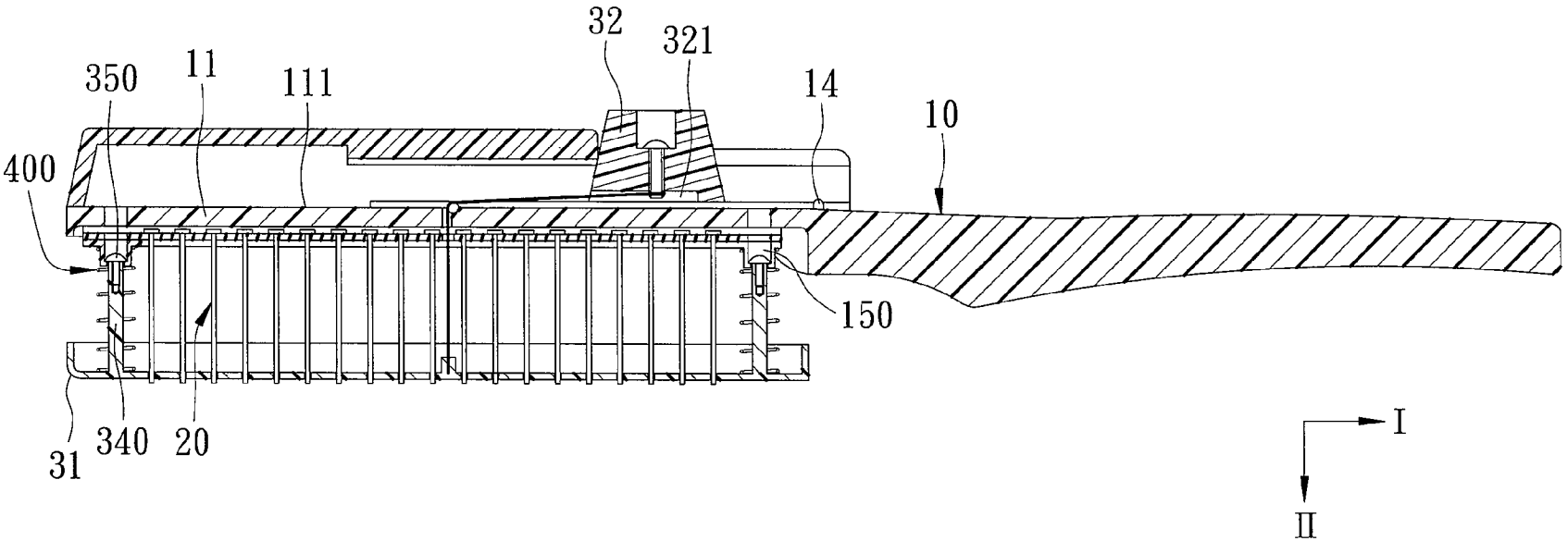
FIG. 10 is the same view as FIG. 9 but illustrating that the hair-removing plate moves away from the base plate when the push member slides toward the through hole.

FIGS. 9 and 10 illustrate the fourth preferred embodiment of the brush according to the present invention. The fourth preferred embodiment differs from the third preferred embodiment only in that the brush does not include the returning spring 50 and the receiving recess 15 but includes two slide holes 150, two rods 340, two stop elements 350 and two returning springs 400.

The two slide holes 150 are formed in proximity to two opposite sides of the bristle unit 20. The two rods 340 are disposed on a top surface of the hair-removing plate 31 to respectively extend through the slide holes 150. The two stop elements 350 are respectively disposed on two upper ends of the two rods 340 to limit the movement of the rods 340. The two returning springs 400 are connected between the bristle plate 21 and the hair-removing plate 31 and are respectively sleeved around the two rods 340 so that the returning springs 400 bias the hair-removing plate 31 to move away from the bristle plate 21 to the cleaning position.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A brush comprising:

a brush body including a base plate, at least one through hole extending through upper and lower surfaces of said base plate, and a guide rail extending above and along said upper surface;

a bristle unit including a plurality of bristles connected to said base plate adjacent to said lower surface and extending in a direction transverse to said upper and lower surfaces of said base plate;

a hair-removing plate disposed movably below said lower surface of said base plate and formed with a plurality of bristle holes to permit said bristles to pass therethrough;

a push member disposed above said upper surface of said base plate and connected slidably to said guide rail;

at least one flexible strip that extends through said through hole, that is connected to said push member and said hair-removing plate, and that has a first section extending along said upper surface from said push member toward said through hole, and a second section bending from said first section and extending through said through hole to connect to said hair-removing plate, said push member being slidable along said guide rail and toward or away from said through hole so as to move said hair-removing plate away from or toward said lower surface of said base plate, said hair-removing plate moving away from said lower surface of said base plate when said push member slides toward said through hole; and a returning spring connected between said base plate and said push member, said returning spring biasing said push member to slide away from said through hole;

wherein said bristle unit further includes a bristle plate attached to said base plate adjacent to said lower surface and holding said bristles, said bristle plate having a through slot aligned with said through hole of said base plate, said second section of said flexible strip extending through said through hole and said through slot to connect to said hair-removing plate.

2. The brush of claim 1, wherein said base plate further has a mount protruding from said upper surface of said base plate, said mount having a channel formed therein to serve as said guide rail, and a hollow space communicated with said channel above said upper surface, said first section of said flexible strip extending in said hollow space.

3. The brush of claim 1, wherein said flexible strip has a curve cross section transverse to a length direction of said flexible strip, and an intermediate part that is convexed between two longitudinal edges of said flexible strip, which are opposite to each other in a transverse direction that is transverse to said length direction of said flexible strip, said flexible strip being resilient in the transverse direction and being stiff in said length direction.

4. The brush of claim 3, wherein said through hole is a narrow rectangular through hole that is confined by a hole wall, a convexed surface of said intermediate part contacting resiliently and slidingly said hole wall of said through hole.

5. The brush of claim 1, further comprising a returning spring connected between said bristle plate and said hair-removing plate, said returning spring biasing said hair-removing plate away from said bristle plate.

6. The brush of claim 5, wherein said base plate further has a locking element disposed in proximity to said upper surface to interlock with said push member after said push member is slid away from said through hole to move said hair-removing plate toward said lower surface of said base plate.

7. A brush comprising:

a brush body including a base plate, at least one through hole extending through upper and lower surfaces of said base plate, and a guide rail extending above and along said upper surface;

a bristle unit including a plurality of bristles connected to said base plate adjacent to said lower surface and extending in a direction transverse to said upper and lower surfaces of said base plate;

a hair-removing plate disposed movably below said lower surface of said base plate and formed with a plurality of bristle holes to permit said bristles to pass therethrough;

a push member disposed above said upper surface of said base plate and connected slidably to said guide rail;

at least one flexible strip that extends through said through hole, that is connected to said push member and said hair-removing plate, and that has a first section extending along said upper surface from said push member toward said through hole, and a second section bending from said first section and extending through said through hole to connect to said hair-removing plate, said push member being slidable along said guide rail and toward or away from said through hole so as to move said hair-removing plate away from or toward said lower surface of said base plate, said hair-removing plate moving away from said lower surface of said base plate when said push member slides toward said through hole; and a returning spring connected between said base plate and said push member, said returning spring biasing said push member to slide toward said through hole;

wherein said bristle unit further includes a bristle plate attached to said base plate adjacent to said lower surface and holding said bristles, said bristle plate having a through slot aligned with said through hole of said base plate, said second section of said flexible strip extending through said through hole and said through slot to connecting to said hair-removing plate.

8. The brush of claim 7, wherein said base plate further has a locking element in proximity to said upper surface to interlock with said push member after said push member is slid away from said through hole to move said hair-removing plate toward said lower surface of said base plate.

* * * * *